United States Patent [19]

Davis

[11] 4,239,227

[45] Dec. 16, 1980

[54] ATHLETIC SWING TRAINING DEVICE AND METHOD

[76] Inventor: Leighton I. Davis, 729 Stagecoach SE., Albuquerque, N. Mex.

[21] Appl. No.: 56,945

[22] Filed: Jul. 12, 1979

[51] Int. Cl.[3] ..... A63B 69/36

[52] U.S. Cl. ..... 273/186 A; 273/186 C; 273/194 R; 273/183 B

[58] Field of Search ..... 273/186 R, 186 A, 183 D, 273/80 B, 77 A, 194 R

[56] References Cited

U.S. PATENT DOCUMENTS

| | | | |
|---|---|---|---|
| 2,787,470 | 4/1957 | Barrus et al. | 273/186 A |
| 3,106,403 | 10/1963 | Kirkman | 273/186 A |
| 3,226,704 | 12/1965 | Petrash | 273/186 A |
| 3,270,564 | 9/1966 | Evans | 273/186 A X |
| 3,318,602 | 5/1967 | Kunihisa | 273/186 A X |
| 3,380,305 | 4/1968 | Charell | 273/186 A X |
| 3,436,076 | 4/1969 | Barthol | 273/186 A X |
| 3,677,553 | 7/1972 | Moore | 273/186 A |
| 3,717,857 | 2/1973 | Evans | 273/186 A X |
| 3,788,647 | 1/1974 | Evans | 273/186 A |
| 3,792,863 | 2/1974 | Evans | 273/186 A |
| 3,801,108 | 4/1974 | Murray | 273/186 R |
| 3,806,131 | 4/1974 | Evans | 273/186 A |
| 3,945,646 | 3/1976 | Hammond | 273/186 A |

*Primary Examiner*—George J. Marlo

*Attorney, Agent, or Firm*—Schuyler, Banner, Birch, McKie & Beckett

[57] ABSTRACT

An athletic swing timing training device and method are disclosed for an athletic striking implement having a flexible shaft. The device includes indicating components for stroboscopically illuminating the implement to visually freeze the apparent position of the implement relative to the object to be struck and relative to the arms and body of the user, and a sensor carried by the implement for actuating the indicating components when the shaft completes a predetermined pattern of flexural movement. The device is particularly well suited for practicing a golf swing.

54 Claims, 15 Drawing Figures

ATHLETIC SWING TRAINING DEVICE AND METHOD

BACKGROUND OF THE INVENTION

1. Field of the Invention

The present invention relates to athletic training devices and methods and, more particularly, to training devices and methods for fostering the proper timing of the swing of an athletic implement such as a golf club.

2. Description of the Prior Art

In athletic games wherein a bat, club or racket is used to strike a playing object, such as a ball, it is well recognized that successful play is largely dependent upon the proper swing or stroke employed. This is overwhelmingly the case with golf, and much has been written descriptive of what a perfect golf swing should comprise.

The swinging of a golf club entails the transfer of energy from a golfer's muscles to the angular momentum of the body, arms and golf club, and finally to the kinetic energy of the club head as it impacts the golf ball. The golfer's legs, hips, torso, arms and wrists all participate in these motions, progressively transferring energy from the muscles of the body to the kinetic energy of the moving club head. As the club is accelerated during approximately the first two thirds of the downswing, the club shaft is bent rearwardly away from the ball. During the last third of the downswing, the angular momentum of the system is transferred to club momentum by the golfer in uncocking his wrists. This rotation within an already rotating system gives rise to a Coriolis acceleration which, in addition to the other continuing energy inputs into the system during the swing, causes the club shaft to unbend and whip the club head forward into the ball.

It is obvious that there is a maximum transfer of potential energy from the bent club shaft to the moving club head at the instant that the club shaft straightens. If the shaft is still appreciably bent to the rear at impact, some unused energy remains in the bent shaft, and the momentum of the club head is less than a maximum. On the other hand, if the shaft straightens before impact, some of the kinetic energy of the club head is wasted by being converted into potential energy in bending the club shaft forwardly. In this instance, the momentum of the club head is reduced below an attainable maximum before impact. The bending of the shaft is a fine-grained, vernier type of motion included within the rotation of the club about the wrists and the rotation of a club and arms about the golfer's body. As such, shaft bending or flexing provides accurate insight into the mechanics of the motion. Hence, a sensor on the club shaft is a valid and perceptive indicator of the correctness of the timing and force of the swing.

Many prior art devices have utilized the information yielded by a sensor mounted on a golf club shaft in a variety of ways. Many of these, such as those disclosed by Evans in U.S. Pat. Nos. 3,270,564, 3,717,857, 3,788,647, 3,792,863 and 3,806,131 and Hammond in U.S. Pat. No. 3,945,646 are devices which sense flexural movement of the club shaft by means of a strain gauge, and display this and other measured parameters on a cathode ray tube as a function of time. While the information derived is valuable, at least a brief period of time is required to analyze it in order to determine the effectiveness of the just completed swing. Other devices, such as those of Kirkman, U.S. Pat. No. 3,106,403 and Moore, U.S. Pat. No. 3,677,553 are more simplistic in their approach and provide more immediate feedback. In these devices, an indicator light mounted on the shaft or head of the club is illuminated when the proper amount of centrifugal force is achieved during the swing.

SUMMARY OF THE INVENTION

Accordingly, it is an object of the present invention to obviate the above-noted shortcomings and disadvantages of the prior art by providing a simple, inexpensive training device for fostering proper timing of the swing of an athletic striking implement such as a bat, club or racket.

Another object of the invention is to provide such a device which does not require the use of a specially designed implement, but may be used in conjunction with any striking implement of the user's choice.

Another object of the invention is to provide such a device which will provide positive and immediate feedback to the user so that he may take immediate corrective measures in subsequent swings without delay.

Another object of the invention is to provide such a device which may be used in conjunction with conventional photographic equipment to record the precise position of the implement at the critical point of interest in the swing.

Another object of the invention is to provide such a device which will discriminate between actual practice swings of the implement and transient movements of the implement prior to or during the swing.

Another object of the invention is to provide such a device which is specifically adapted to use with a golf club.

Another object of the invention is to provide a training method for fostering proper timing of the swing of an athletic striking implement which may be simply performed and which will provide the user with immediate positive feedback as to the correctness of his timing after each swing.

Another object of the invention is to provide such a method specifically adapted to the sport of golf.

These and other objects of the present invention are provided in an athletic swing timing training device including an athletic striking implement having a grip portion, an impact portion for striking a playing object and a flexible shaft interconnecting said grip and impact portions, with an improvement comprising indicating means actuatable to stroboscopically illuminate the implement to visually freeze its apparent position, and sensing means carried by the implement for detecting flexural movement of the shaft and actuating the indicating means when the shaft completes a predetermined pattern of flexural movement. The sensing means may comprise discriminating means for preventing actuation of the indicating means during transient flexural movement of the shaft. Such discriminating means may comprise a discriminating RC circuit coupled to a controlled switch means for actuating the indicating means. The discriminating means may also (or alternatively) comprise a user-operable discriminator switch for overriding the sensing means to selectively prevent actuation of the indicating means. The device may be specifically used in conjunction with a golf club.

A sensor for detecting flexural movement of the shaft of such an implement is provided and may comprise a substantially rigid elongated mounting member adapted to be secured near one of its ends to the grip portion of the implement and extend therefrom alongside the shaft, and a pair of engageable electrical switch contacts carried at the free end of the mounting member, one of the contacts adapted to be coupled to the shaft and movable into and out of engagement with the other contact in response to the flexing movements of the shaft. These contacts may comprise cantilevered leaf springs projecting from the free end of the mounting member alongside the shaft, one of the leaf springs having a bearing surface adapted to bear against the shaft.

The invention also provides a training method for fostering proper timing of the swing of such an athletic striking implement comprising the steps of swinging the implement in normal playing fashion such that the shaft undergoes a predetermined pattern of flexural movement, detecting the flexural movement of the shaft during the swing, and stroboscopically illuminating the implement upon detecting the completion of the pattern of movement to visually freeze the apparent position of the implement. Such a method is adaptable to the sport of golf, wherein during the downswing of the club, the club shaft initially bends rearwardly away from the impact point and then straightens as the club head moves toward the impact point.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

DESCRIPTION OF THE INVENTION

In the preferred embodiment shown in the Figures, the training device according to the invention is illustrated and described in terms of a golf swing training device. It is to be understood, however, that this device can be used in conjunction with any athletic striking implement wherein the flexural movement of the shaft of the implement is an important parameter in determining the proper timing of the swing.

Figure 1:
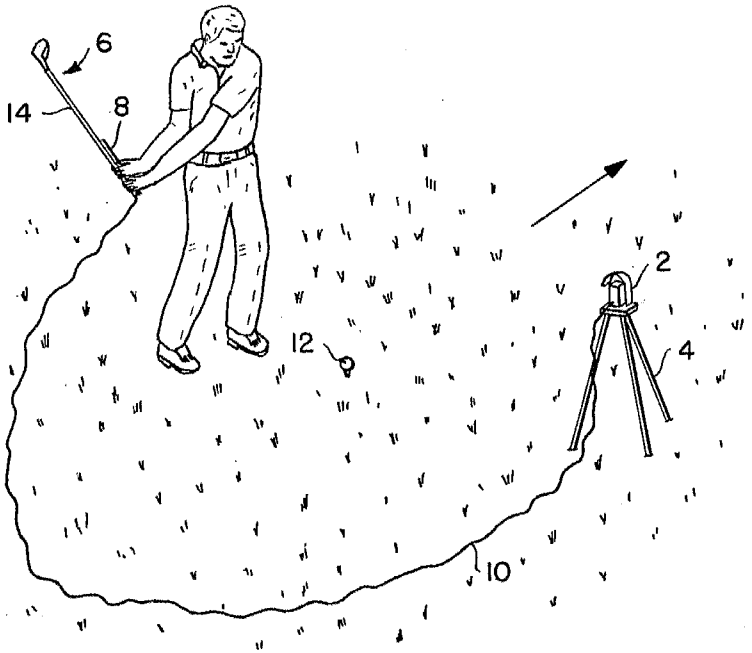
FIG. 1 is a perspective view showing the general arrangement of the training device according to the invention as it is used in practicing a golf swing.
Figure 3:
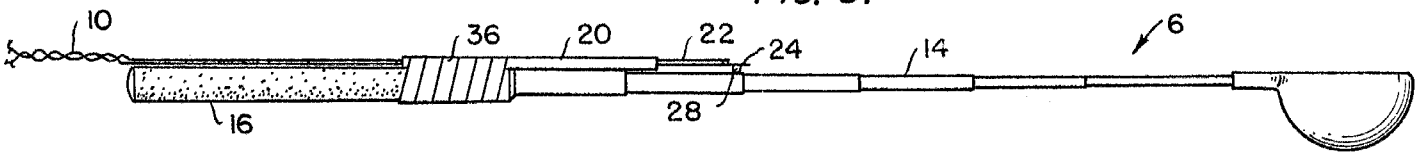
FIG. 3 is a top plan view of the sensor according to the invention installed on the golf club.
Figure 4:
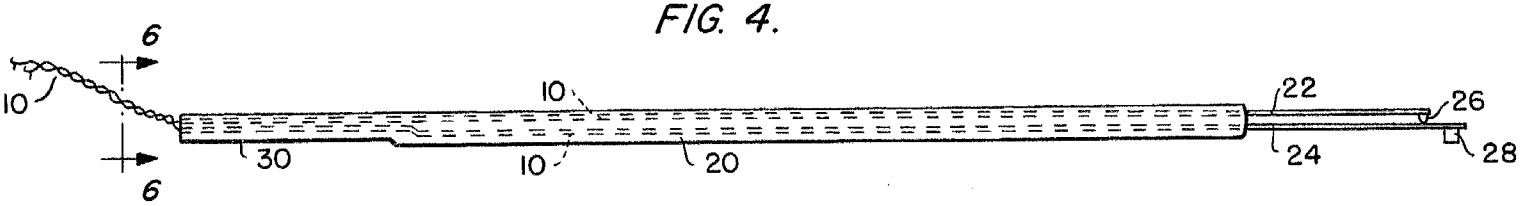
FIG. 4 is an enlarged view of the sensor shown in FIG. 3.
Figure 5:
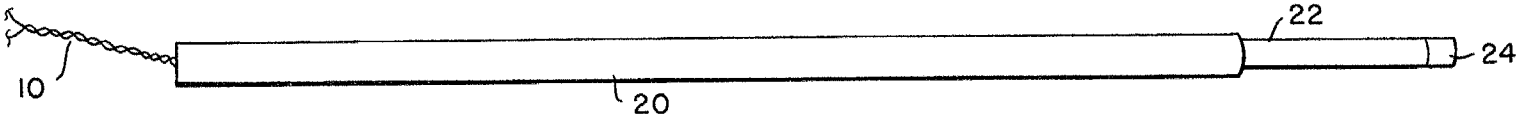
FIG. 5 is a side view of the same.
Figure 7:
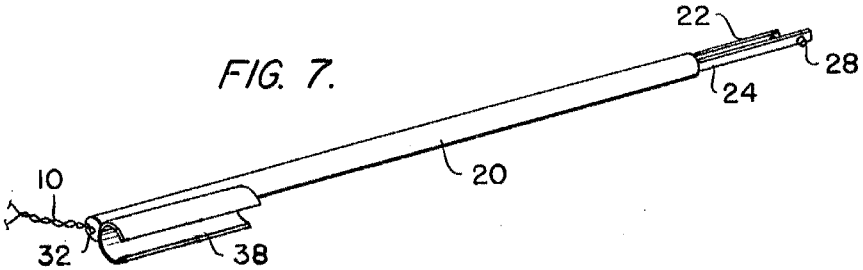
FIG. 7 is a perspective view of a modification of the same.
Figure 6:
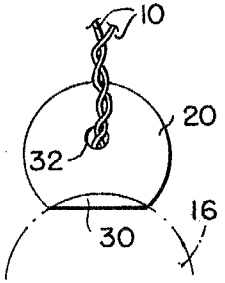
FIG. 6 is an end view of the same.

Referring to FIG. 1, the device according to the invention comprises an indicating means in the form of a strobe light 2 mounted on a tripod 4 positioned opposite a golfer swinging a golf club 6 on which the sensor 8 of the invention is mounted. Sensor 8 is connected to strobe light 2 by means of wire leads 10, which may be fastened to the golfer's arm, shirt or sweater to prevent entanglement. Alternatively, wire leads 10 may be dispensed with if sensor 8 comprises an RF transmitter for transmitting the sensed information to an RF receiver in strobe light 2. Such an arrangement is conventional and is used in the devices disclosed in the aforementioned Evans and Hammond patents.

Figure 2:
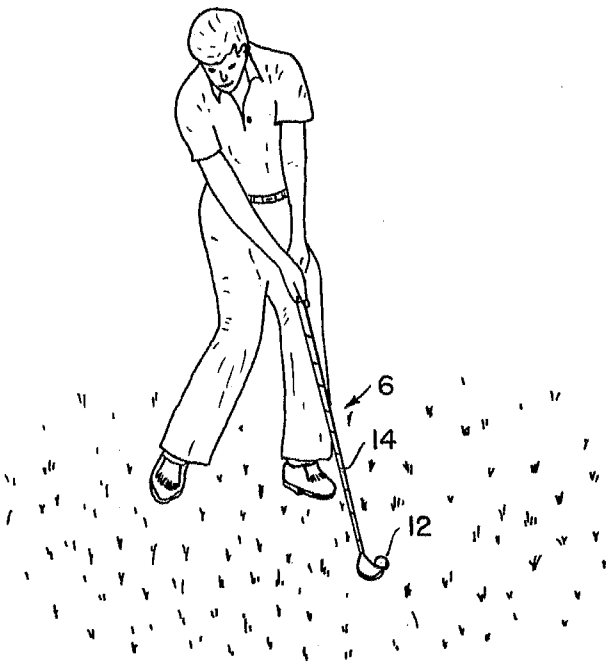
FIG. 2 is a perspective view of a golfer at the precise moment during the swing that the club shaft straightens and the indicating means is actuated to visually freeze the apparent position of the club and golfer.

Strobe light 2 contains a conventional flash tube and its own power supply and may actually consist of a conventional electronic photographic flash unit. When the critical event of club shaft unbending or straightening occurs during the swing, electrical contacts in sensor 8 close to complete a circuit to strobe light 2, which emits a stroboscopic flash to visually freeze the apparent position of the club 6. Ideally, the club shaft should be almost completely unbent as the club head makes contact with the ball 12, as illustrated in FIG. 2. The bright stroboscopic flash presents a bright image of the apparently stationary golf club to the retinas of the golfer's eyes. This image lingers for a brief but sufficient period of time to provide the positive and immediate feedback required for the golfer to be able to correct his motions on the next swing. A camera may be used with strobe light 2 to photographically record the event. Cameras which use so-called "instant film" (such as those manufactured by Polaroid and Kodak) are particularly well-suited for this purpose.

Referring to FIGS. 3–7, one sensor according to the invention comprises an elongated mounting member in the form of a rigid dowel or rod 20. A pair of conventional leaf spring electrical contacts 22 and 24 are glued or otherwise suitably secured to the end of rod 20. In their unstressed condition, leaf spring contacts 22 and 24 are normally closed at their point of contact 26. Contact 24 carries a bearing block 28 which is adapted to bear against the surface of club shaft 14 as described more fully below. The opposite end of rod 20 is contoured at 30 to mate with the surface of golf club grip 16. A central longitudinal bore 32 extends through rod 20. Wire leads 10 are carried through this channel, each being connected to a single leaf spring contact.

The sensor may be attached to golf club 6 by wrapping tape 36 around the overlapping portions of rod 20 and grip 16. Alternatively, rod 20 may be provided with a split cylindrical collar 38 (see FIG. 7) which is adapted to snugly engage grip 16. Or, the rod with its contacts may be inserted in the hollow shaft of the golf club, with the grip end fastened rigidly to the butt end of the shaft, and adjusted so that the leaf spring contacts bear on the inner surface of the hollow shaft in a manner similar to the exterior mounting.

When in position on golf club 6, this sensor will function to detect the flexural condition of shaft 14 by virtue of the alternative open or closed condition of contacts 22 and 24. When club shaft 14 is straight, contacts 22 and 24 will remain closed. When shaft 14 bends rearwardly, as it does during the approximately first two thirds of the downswing, spring contact 24 will flex rearwardly with shaft 14 by virtue of its spring bias and contact with the shaft through block 28. When this flexing occurs, the contacts will separate. When the shaft returns to a substantially straightened condition, the contacts will again close.

Rod 20 may be made of any rigid material. However, it is preferred that a lightweight, nonconducting material be used so that contacts 22 and 24 can be simply mounted, and the club balance will not be appreciably altered. Bamboo is suitable for this purpose, and possesses the added advantage of being naturally hollow for the passage of leads 10. Other materials may be used, such as a lightweight plastic molded in the desired size and shape with spaced electrical leads embedded therein. Rod 20 should be long enough to extend a sufficient distance along shaft 16 so that contact 24 will flex appreciably with shaft 16. A rod approximately 7 inches in length and $\frac{1}{4}$ to 5/16 inch in outside diameter has been found to be satisfactory. The contoured portion 30 at the grip-engaging end of rod 20 should have a maximum length of approximately 2 inches, so that only a small portion of the grip (typically 11 inches in length) is occupied by rod 20.

Figure 8:
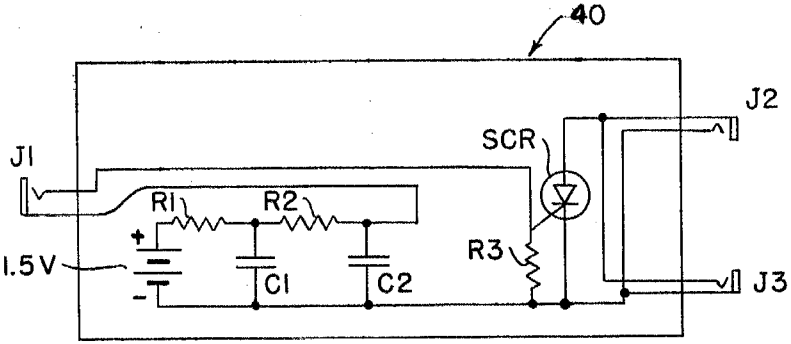
FIG. 8 is a circuit diagram of a discriminator circuit used in conjunction with the sensor of FIGS. 3–7.

In order to effectively operate strobe light 2 with the sensor of FIGS. 3–7, wire leads 10 are connected to strobe light 2 through a discriminator circuit 40 illustrated in FIG. 8. This circuit effectively monitors the cyclic switching of contacts 22 and 24 and will permit strobe light 2 to flash if contacts 22 and 24 cycle at or below a particular frequency as governed by the flexural movement of shaft 14. In this respect, discriminator circuit 40 functions as a low pass filter, and will prevent the triggering of strobe light 2 when the golfer waggles the club prior to initiating the swing and during any other transient movements of the club.

Leads 10 are connected to jack J1 of discriminator circuit 40. Jack J1 is included in an RC circuit consisting of R1, R2, C1 and C2 which has a particular time constant. This circuit is connected to a silicon controlled rectifier (SCR) or other controlled switch means shunted by a resistor R3. Typical values for these components are as follows:

$R1 = R2 = 330\ k\Omega$ $C_1 = C_2 = 0.33\ \mu fd$ $R_3 = 10\ k\Omega$

SCR: 400 v.

Jack J2 is connected to strobe light 2. Jack J3 may be connected to an alternative switch as described more fully below.

Figure 12:
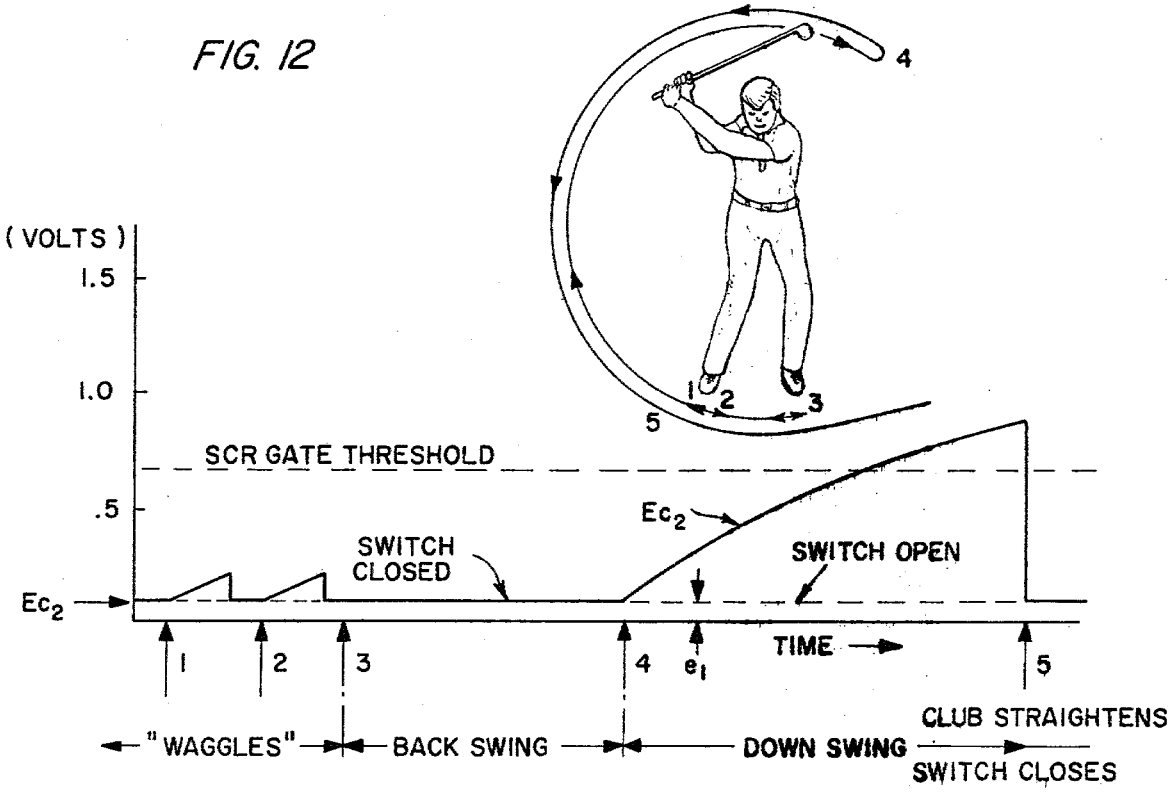
FIG. 12 is a schematic representation of the operation of the device according to the invention using the sensor of FIGS. 3 through 7 and the discriminator circuit of FIG. 8.
Figure 13:
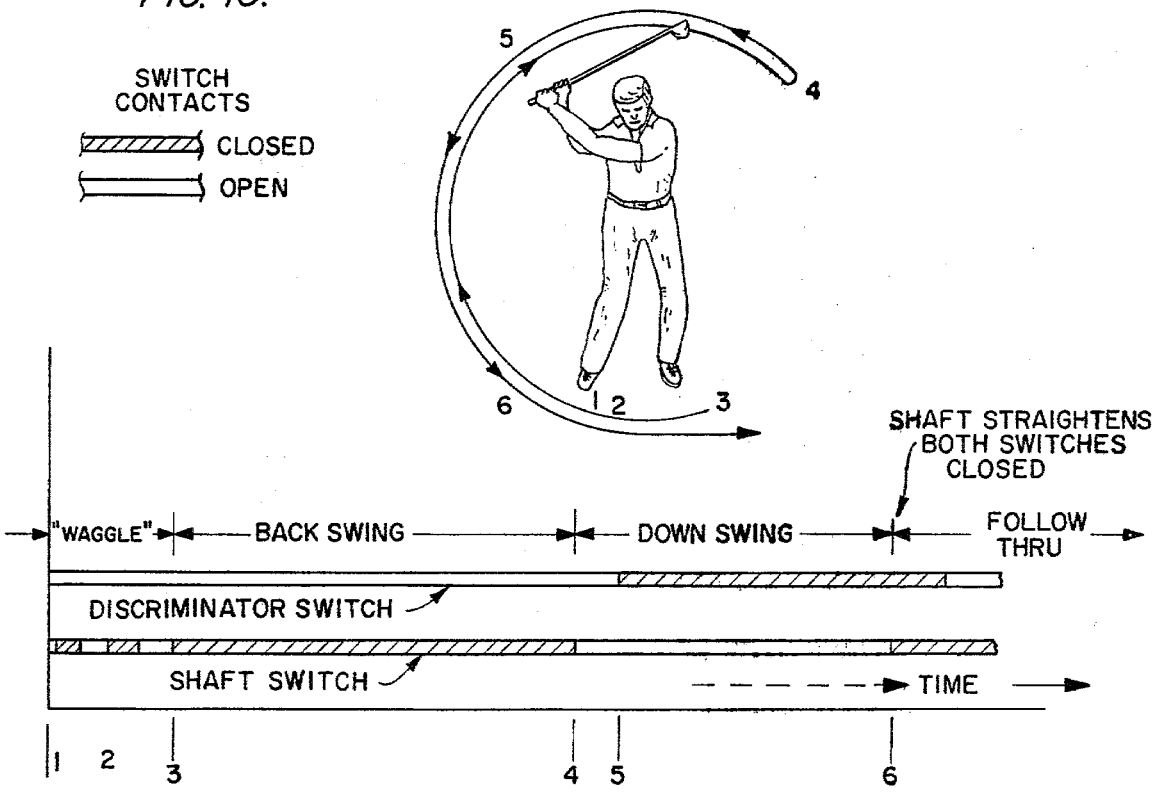
FIG. 13 is a schematic representation of the operation of the device using the sensor of FIGS. 9–11.

The operation of discriminator circuit 40 may be understood more clearly with reference to FIG. 12. This Figure illustrates various positions of the club during the golfer's swing and plots voltage across the gate of the SCR as a function of time and club position. Before initiating the swing, and during the backswing, the contacts 22 and 24 are closed and C2 charges to $e_1$, a level determined by:

$R3/R1+R2+R3$ which is insufficient to cause the SCR to conduct. If the golfer waggles the club causing the contacts to open and close momentarily, the RC time constant of the circuit prevents the charge on C2 from building up to a point above the threshold of the SCR gate. Time constants in the neighborhood of 200 milliseconds have been found to be effective. When the club shaft bends rearwardly during the downswing, contacts 22 and 24 open to open the path from C2 to the gate of the SCR. C2 then charges through R1 and R2 to a level sufficient to cause the SCR to conduct when the contacts close. When the shaft 14 unbends and substantially straightens, contacts 22 and 24 close and C2 discharges through the gate of the SCR, which then conducts, thereby triggering strobe light 2.

Figure 9:
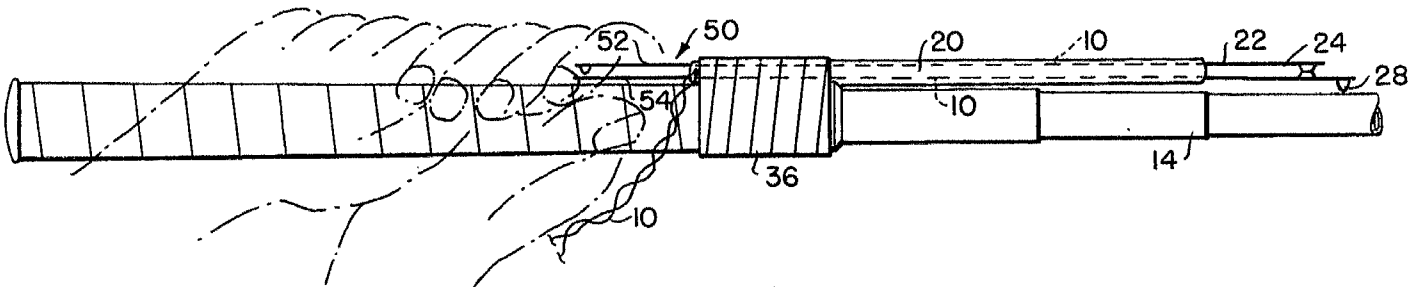
FIG. 9 is a top plan view of another embodiment of the sensor according to the invention installed on a golf club.
Figure 10:
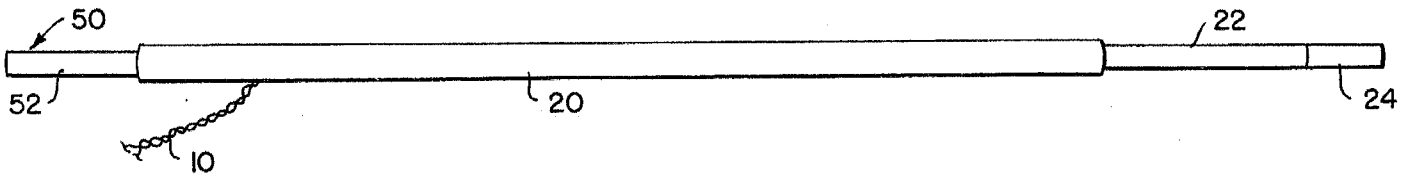
FIG. 10 is a side view of the same.
Figure 11:
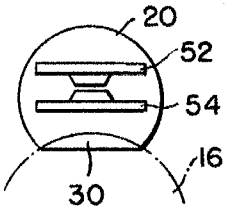
FIG. 11 is an end view of the same.

An alternative sensing and discriminating device according to the invention is illustrated in FIGS. 9–11. The rod and the leaf spring contacts of this device are substantially identical to those used in the sensor of FIGS. 3–7, and are designated with like reference numerals. A grip discriminator switch 50 is provided at the grip-engaging end of rod 20. Grip switch 50 comprises a pair of leaf spring contacts 52 and 54 which project from the end of rod 20 and overlie a portion of grip 16. These contacts may be manipulated by the right index finger of the golfer (or by the left index finger of a left-handed golfer using a left-handed club) and are in series with contacts 22 and 24. Hence, grip switch 50 may be used to override contacts 22 and 24 at the will of the golfer. With this arrangement, the discriminator circuit 40 need not be used.

In use, the golfer would leave discriminator switch 50 open at all times prior to initiation of the downswing so that, whatever the positions of contacts 22 and 24, the circuit to strobe light 2 would remain open. Upon initiating the downswing, contacts 22 and 24 open when the shaft flexes rearwardly, and contact 52 of discriminator switch 50 may then be depressed to close the switch. In this state, the system is "primed" so that, upon the closing of contacts 22 and 24 when shaft 14 straightens, strobe light 2 will fire. It has been found that very little practice is required to accustom oneself to the use of discriminator switch 50.

Figure 15:
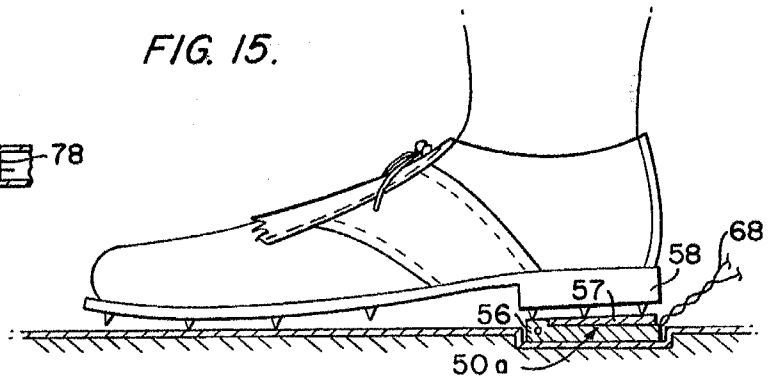
FIG. 15 shows a heel-actuated discriminator switch.

While discriminator switch 50 has been illustrated as a grip switch for manual operation, it is contemplated that the switch may be actuated in any manner as long as it can be used to prevent premature actuation of strobe light 2. For example, the switch could be an insulated jaw-actuated switch placed between the teeth of the golfer and closed when the golfer clenches his teeth. Alternatively, as illustrated in FIG. 15, the discriminator switch could be a heel-actuated switch **50*a* with normally open contacts. The heel switch has a base 56 and a spring-loaded actuating plate 57. The switch is wired into the circuit and placed so as to be operated by the left heel 58 (of a right handed golfer). This is an additional attractive feature of this training device because many professional golf instructors teach their students to raise the left heel on the backswing, and start the downswing by returning the heel to the ground in firm fashion. This arrangement of the discriminator switch combines the discriminating function with an attractive training feature. Other arrangements may be used as long as the proper sequence of switch operation is afforded to prevent unwanted triggering of the strobe light 2. Leads 10 may be connected directly to strobe light 2, or may be connected thereto through jack J3. Alternatively, the sensor of FIGS. 9–11 may be used in conjunction with discriminator circuit 40 by connecting leads 10 to jack J1. With this arrangement, discriminator circuit 40 will prevent triggering of strobe light 2 in the event discriminator switch 50** is inadvertently closed prior to initiating the downswing.

Figure 14:
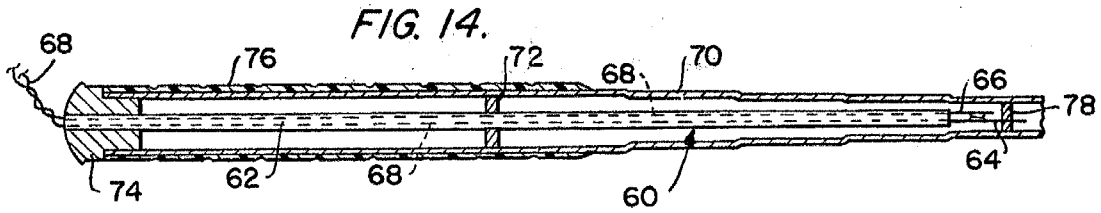
FIG. 14 shows an embodiment of the sensor according to the invention installed within a golf club shaft.

The sensors described above are simple and inexpensive additions to existing golf clubs, but it is contemplated that a specially designed golf club could be constructed having internal contacts within the shaft which would operate in a similar manner. Such an arrangement is illustrated in FIG. 14. Sensor 60 is similar in construction and operation to the sensor of FIGS. 3–7, with a rigid rod 62, leaf spring contacts 64 and 66, and wire leads 68. Sensor 60 is rigidly supported centrally within the club shaft 70 by means of an apertured central spacer 72 and an apertured end plug 74 which closes the end of grip portion 76, preferably by a mild force fit. Spacer 72 and end plug 74 may be made of wood, plastic or any other lightweight material. The free end of contact 64 is engaged by an insulated standoff 78, which is in contact with the inner surface of shaft 70. Standoff 78 transmits flexural movement of shaft 70 with respect to grip portion 76 directly to contact 64 to open or close the contacts. The entire sensor, with spacer 72, standoff 78 and end plug 74 attached, can be removed for inspection or adjustment of the contacts by withdrawing end plug 74 from grip portion 76. End plug 74 may advantageously be keyed to grip portion 76 to insure proper angular orientation of the contacts with respect to the club head.

It will be obvious to one of ordinary skill that numerous modifications may be made without departing from the true spirit and scope of the invention which is to be limited only by the appended claims. For example, any type of switching mechanism may be used which will respond in on/off fashion to the flexural movement of the club shaft. In addition, with appropriate circuitry, the operating arrangement of the switch contacts may be reversed so that the strobe light would be triggered upon the opening of the contacts when the shaft unbends. Also, adjustment screws can be provided to control the position and clearance of the contacts of the leaf springs. A further modification could involve providing means for varying the time constant of the discriminator circuit of FIG. 8. By increasing the time constant slightly, the golfer would have to slow down to the start of his downswing. This is a desirable swing characteristic. If he had an undesirably short, fast backswing and a "jerk" to start the downswing, the time involved will be shorter than the RC time constant, and the strobe light will not illuminate the "scene."

I claim:

1. In an athletic swing timing training device including an athletic striking implement having a grip portion, an impact portion for striking a playing object and a flexible shaft interconnecting said grip and impact portions, the improvement comprising:

indicating means actuatable to stroboscopically illuminate said implement to visually freeze its apparent position; and sensing means carried by said implement for detecting flexural movement of said shaft and actuating said indicating means when said shaft completes a predetermined pattern of flexural movement.

2. A device according to claim 1 wherein said sensing means further comprises discriminating means for preventing actuation of said indicating means during transient flexural movements of said shaft.

3. A device according to claim 1 wherein said sensing means comprises switching means carried by said implement for detecting flexural movement of said shaft, said switching means cyclable in response to the flexing movements of said shaft between a first position corresponding to a first flexural condition of said shaft prior to completion of said predetermined pattern of flexural movement and a second position corresponding to a second flexural condition of said shaft at the completion of said pattern of movement.

4. A device according to claim 3 wherein said sensing means further comprises discriminating means coupled to said switching means for preventing actuation of said indicating means during substantially short cycling of said switching means which results from transient movements of said implement.

5. A device according to claim 4 wherein said discriminating means comprises a discriminator circuit which actuates said indicating means when said switching means switches to its second position only if said switching means remained in its first position for at least a predetermined period of time.

6. A device according to claim 5 wherein said discriminator circuit comprises an RC circuit having a time constant which is greater than any short duration of the first position of said switching means during substantially short cycling thereof resulting from transient movements of said implement.

7. A device according to claim 6 wherein said time constant is equal to said predetermined period of time.

8. A device according to claim 7 wherein said discriminator circuit further comprises controlled switch means coupled to said RC circuit for actuating said indicating means.

9. A device according to claim 8 wherein said controlled switch means is triggered when the output of said RC circuit is at least equal to a predetermined threshold level and said switching means switches to its second position.

10. A device according to claim 3 wherein said implement is a golf club, said first flexural condition of said shaft is a rearwardly bent condition away from the playing object to be struck, and said second flexural condition is a substantially straight condition as said impact portion moves to strike the playing object.

11. A device according to claim 4 wherein said discriminating means comprises a user-operable two-position discriminator switch in series with said switching means and operative in one position to prevent said switching means for actuating said indicating means.

12. A device according to claim 11 wherein said discriminator switch is disposed along said grip portion of said implement for manual engagement by the user.

13. A device according to claim 12 wherein said discriminator switch is mounted on said switching means.

14. A device according to claim 11 wherein said discriminator switch is a heel switch positioned so as to be operable by the heel of the user.

15. A device according to claim 5 wherein said discriminating means further comprises a user-operable two-position discriminator switch in series with said switching means and operative in one position to prevent said switching means from actuating said indicating means.

16. In a golf swing training device including a golf club having a grip, a head for striking a ball at rest at an impact point and a flexible shaft interconnecting said grip and head, and switching means carried by said club and responsive to club motion to actuate an indicating means at a critical point in the swing of said club to foster proper timing of the swing, the improvement comprising:

switch mounting means rigidly secured to said grip and extending along said shaft;

a first switch contact carried by said mounting means adjacent the free end thereof; and a second switch contact coupled to said shaft and movable therewith between alternate positions of engagement with and disengagement from said first contact in response to the flexing movements of said shaft.

17. A device according to claim 16 wherein said mounting means and said switch contacts are disposed along the outside of said shaft.

18. A device according to claim 17 wherein said first switch contact comprises a cantilevered leaf spring contact projecting from the free end of said mounting means along said shaft.

19. A device according to claim 18 wherein said second switch contact comprises a cantilevered leaf spring contact projecting from the free end of said mounting means between said first contact and said shaft and bearing against said shaft to flex therewith.

20. A device according to claim 16 wherein said mounting means and said switch contacts are disposed within said shaft.

21. A device according to claim 16 wherein said mounting means comprises a split collar adjacent its grip-engaging end for encircling said grip portion to secure said mounting means thereto.

22. A device according to claim 16 further comprising discriminating means coupled to said switch contacts and operative to prevent actuation of said indicating means during substantially short cycling of said switch contacts due to transient flexing of said shaft during waggling and other transient movements of said club.

23. A device according to claim 22 wherein said second switch contact assumes a first of said alternate positions when said shaft is bent rearwardly away from said impact point, and assumes a second of said alternate positions when said shaft is substantially straight, said discriminating means operative to permit actuation of said indicating means when said second switch contact moves to its second position only if it remained in its first position for at least a predetermined period of time.

24. A device according to claim 23 wherein said discriminating means comprises an RC circuit having a time constant which is greater than any short duration of the first position of said second switch contact resulting from transient movements of said club.

25. A device according to claim 24 wherein said time constant is equal to said predetermined period of time.

26. A device according to claim 25 wherein said time constant is approximately 200 milliseconds.

27. A device according to claim 22 wherein said discriminating means comprises a manually operable two position discriminator switch secured to the grip-engaging end of said mounting means in series with said switch contacts and operative in one position to prevent said switch contacts from actuating said indicating means.

28. A device according to claim 22 wherein said discriminating means comprises a heel-actuated two position discriminator switch positioned so as to be operable by the heel of the user.

29. A device according to claim 23 wherein said discriminating means further comprises a user-operable two-position discriminator switch in series with said switch contacts and operative in one position to prevent said switch contacts from actuating said indicating means.

30. A device according to claim 25 wherein said discriminating means further comprises controlled switch means coupled to said RC circuit and adapted to actuate said indicating means.

31. A device according to claim 30 wherein said controlled switch means is triggered when the output of said RC circuit is at least equal to a predetermined threshold level and said second switch contact moves to its second position.

32. In a golf swing training device including a golf club having a grip, a head for striking a ball at rest at an impact point and a flexible shaft interconnecting said grip and head, and switching means carried by said club and responsive to club motion to actuate an indicating means at a critical point in the swing of said club to foster proper timing of the swing, the improvement comprising a golfer-engageable discriminator switch in series with said switching means and selectively operable to prevent said switching means from actuating said indicating means during waggling and other transient movements of said club.

33. A device according to claim 32 wherein said discriminator switch comprises a two-position manually operable grip switch mounted along said grip.

34. A device according to claim 32 wherein said discriminator switch is a heel switch positioned so as to be operable by the heel of the golfer.

35. A sensor for detecting flexural movement of the shaft of an athletic striking implement having a grip portion, an impact portion for sriking a playing object and a flexible shaft interconnecting said grip and impact portions, said sensor comprising:

a substantially rigid elongated mounting member adapted to be secured near one of its ends to said grip portion and extend therefrom along said shaft; and a pair of engageable electrical switch contacts carried at the free end of said mounting member, one of said contacts adapted to be coupled to said shaft and movable into and out of engagement with the other contact in response to the flexing movements of said shaft.

36. A sensor according to claim 35 wherein said contacts comprise cantilevered leaf springs projecting from the free end of said mounting member alongside said shaft, one of said leaf springs having a bearing surface adapted to bear against said shaft.

37. A sensor according to claim 35 wherein said mounting member includes a longitudinal bore and wire leads in said bore connected to said contacts.

38. A sensor according to claim 35 further comprising a manually operable grip switch carried at the grip-engaging end of said mounting member and connected in series with said switch contacts for selectively overriding the operation of said switch contacts.

39. A sensor according to claim 35 wherein the grip-engaging end of said mounting member is contoured to mate with the outer surface of said grip portion.

40. A sensor according to claim 39 wherein said contoured mating portion of said elongated member comprises a split collar adapted to encircle said grip portion.

41. A training method for fostering proper timing of the swing of an athletic striking implement having a grip portion, an impact portion for striking a playing object and a flexible shaft interconnecting said grip and impact portions, said method comprising the steps of:

swinging said implement in normal playing fashion such that said shaft undergoes a predetermined pattern of flexural movement;

detecting the flexural movement of said shaft during said swing; and actuating an indicating means to stroboscopically illuminate said implement upon detecting the completion of said pattern of movement to visually freeze the apparent position of said implement, thereby indicating any departure from a correctly timed swing.

42. A method according to claim 41 further comprising the step of discriminating between said predetermined pattern of flexural movement of said shaft during said swing and similar flexural movements of said shaft which occur during transient movements of said implement, and not actuating said indicating means during said transient movements.

43. A method according to claim 42 wherein said detecting step comprises detecting a first flexural condition of said shaft prior to completion of said predetermined pattern of flexural movement, and detecting a second flexural condition of said shaft at the completion of said pattern of movement, said discriminating step comprising comparing the duration of said detected first flexural condition to a predetermined period of time and not actuating said indicating means upon detecting said second flexural condition if said duration is shorter than said predetermined period of time.

44. A method according to claim 43 wherein said implement is a golf club, said swing comprises a backswing to raise said club, and a downswing toward the object to be struck which initially bends said shaft rearwardly away from the object (said first flexural condition) and then substantially straightens said shaft (said second flexural condition) at the completion of said predetermined pattern of movement, and said predetermined period of time is approximately 200 milliseconds.

45. A method according to claim 43 wherein said implement is a golf club, said swing comprises a backswing to raise said club and a downswing toward the object to be struck which initially bends said shaft rearwardly away from the object and then substantially straightens said shaft at the completion of said predetermined pattern of movement, and said discriminating step is effective to prevent unwanted actuation of said indicating means only prior to initiating said downswing.

46. A golf training method for fostering proper timing of the swing of a golf club having a grip, a head for striking a ball at rest at an impact point, and a flexible shaft interconnecting said grip and head, said method comprising the steps of:

swinging said club in normal playing fashion with an initial backswing to raise said club, and a subsequent downswing toward and through said impact point to initially bend said shaft rearwardly away from said impact point and then straighten said shaft;

detecting the flexural movement of said shaft; and actuating an indicating means to stroboscopically illuminate said club upon detecting substantial straightening of said shaft to visually freeze the apparent position of said club relative to the impact point, thereby indicating any departure from a correctly timed swing.

47. A method according to claim 46 further comprising the step of discriminating between the bending and straightening of said shaft which occurs during said downswing, and other flexural movements of said shaft which occur during waggling of said club prior to initiation of said backswing and during other transient movements of said club, and not actuating said indicating means during said waggling and other transient movmements.

48. A method according to claim 47 wherein said discriminating step comprises comparing the duration of the detected rearwardly bent condition of said shaft to a predetermined period of time and not actuating said indicating means upon detecting substantial straightening of said shaft if said duration is shorter than said predetermined period of time.

49. A method according to claim 48 wherein said club includes a detection switch engaged with said shaft and electrically coupled to said indicating means, said switch arranged to remain open when said shaft is bent rearwardly and close when said shaft substantially straightens, said duration being the interval during which said switch remains open.

50. A method according to claim 47 further including a detection switch engaged with said shaft and electrically coupled to said indicating means, said switch arranged to remain open when said shaft is bent rearwardly and close when said shaft substantially straightens, and a normally open discriminator switch in series with said detection switch and said illuminating means, said discriminating step comprising leaving said discriminator switch open prior to initiating said downswing to override said detection switch, and closing said discriminator switch upon initiating said downswing.

51. A method according to claim 50 wherein said discriminator switch is a manually operable switch mounted adjacent said grip.

52. A method according to claim 50 wherein said discriminator switch is a heel switch positioned so as to be depressed and closed by the golfer's heel upon initiating the downswing.

53. A method according to claim 52 wherein said heel is the left heel of a right-handed golfer.

54. A method according to claim 52 wherein said heel is the right heel of a left-handed golfer.

* * * * *